United States Patent [19]

Horbrügger et al.

[11] Patent Number: 4,623,041

[45] Date of Patent: Nov. 18, 1986

[54] ELEVATOR LOAD MEASURING

[75] Inventors: Karl Horbrügger; Jurgen Schlotter, both of Berlin, Fed. Rep. of Germany

[73] Assignee: Otis Elevator Company, Farmington, Conn.

[21] Appl. No.: 663,529

[22] Filed: Oct. 22, 1984

[51] Int. Cl.[4] ..... B66B 5/00

[52] U.S. Cl. ..... 187/29 R; 318/474

[58] Field of Search ..... 187/29; 318/474, 799; 324/83 A, 83 R, 87

[56] References Cited

U.S. PATENT DOCUMENTS 3,026,461 3/1962 Lee ..... 318/474 X 4,321,529 3/1982 Simmonds et al. ..... 324/83 R 4,503,937 3/1985 Cervenec et al. ..... 187/29 R

*Primary Examiner*—William M. Shoop, Jr.

*Assistant Examiner*—W. E. Duncanson, Jr.

*Attorney, Agent, or Firm*—Gerald E. Linden

[57] ABSTRACT

Signals indicative of full load up (FLU), no load down (NLD), and full load down (FLD) are supplied to an elevator controller (16) by a load measuring circuit (28) that is responsive to the phase angle in one line (32) of a bus feeding an AC motor. Based on the FLU and NLD signals the controller implements a slowdown/-stop sequence closer to a landing than without the signals. Based on the FLU and FLD signals, the controller bypasses hall calls.

5 Claims, 4 Drawing Figures

ELEVATOR LOAD MEASURING

DESCRIPTION

BACKGOUND OF THE INVENTION

Superior elevator performance is possible by controlling elevator cab movement in relation to actual cab loads. The ride, for instance, can be smoother because unacceptable acceleration and deceleration rates can be avoided by controlling motor torque as a function of actual weight; uneven or jerky car movement is thus prevented. The capability to know the cab weight at any instant in time consequently can be very useful in providing efficient, comfortable elevator service, mainly because operation can be tailored, in a dynamic way, to actual cab conditions, such as by bypassing hall calls when the cab is full. This capability also provides the possiblity to conserve energy by tailoring power usage to actual requirements. A technique for determining cab weight is disclosed in U.S. Pat. No. 4,330,836 (Donofrio, et al., 1982).

As described in U.S. Pat. No. 4,394,889 (Gray, 1983), entitled MODIFIED SLOWDOWN AND BRAKING OF AN ELEVATOR CAR, elevator response time can be improved by delaying the onset of slowdown and/or braking of an elevator, beyond fixed points selected to accommodate maximum car velocity, in response to a reduced car velocity that is indicative of either a full load up or no load down.

It is an object of this invention to measure load directly using the phase angle between the current and voltage in the bus supplying an AC elevator motor.

DISCLOSURE OF THE INVENTION

According to the invention, the phase angle between current and voltage in one line of a three phase bus going to an AC elevator motor is determined by sensing their respective zero crossings and providing a phase difference signal as a function thereof. The current zero crossing in the line is sensed by a ring transducer and Schmitt trigger, both of which are operated in saturation. The voltage zero crossing is sensed by an opto coupler operated in saturation that is responsive to the voltage between the line and an artificial ground. The output of the trigger is a square wave in phase with the current and the output of the coupler is a squarewave in phase with the voltage. An exclusive OR gate is responsive to the square waves to provide a pulsed output, the mark:space ratio of which is proportional to the phase angle.

According to an aspect of the invention, the pulsed output of the exclusive OR gate is averaged to provide an analog signal that is compared with thresholds indicative of full load up (FLU), no load down (NLD) and full load down (FLD) to provide signals indicative of those conditions. Based on the (FLU) and (NLD) signals, the elevator controller implements a slowdown/stop sequence closer to the landing, since car velocity is slower. Based on the (FLU) and (FLD) signals, the controller bypasses hall calls, since the car is full.

Other objects, features, and advantages of the invention will become apparent in light of the following description.

BEST MODE FOR CARRYING OUT THE INVENTION

Figure 1:
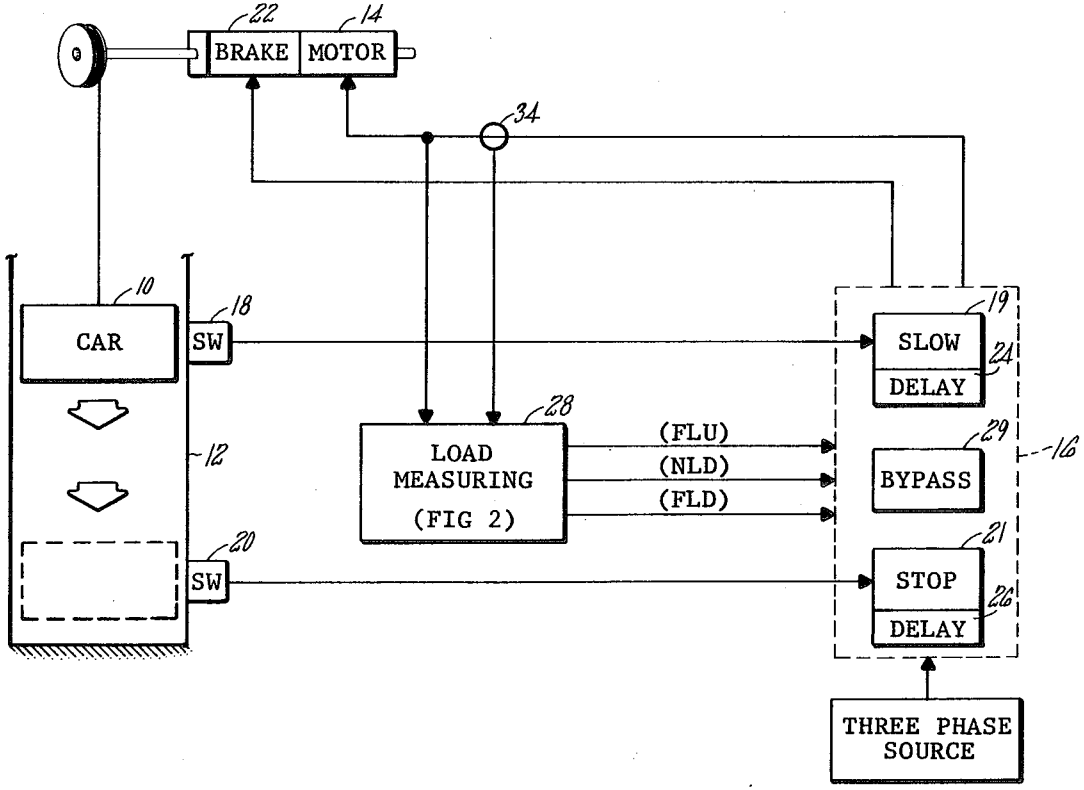
FIG. 1 is a schematic block diagram of an elevator system employing the invention.

FIG. 1 shows an elevator having a car 10 that is moved in a hoistway 12 by a two-speed AC motor 14. A controller 16 selects the motor speed based on the car's position in the hoistway. For instance, as the car descends at full speed to a landing, it passes a slowdown point (as shown in solid lines) and a switch 18 signals the controller 16 to implement a slowdown function 19 and command a lesser speed. When the car reaches a stop point (as shown in broken lines), another switch 20 signals the controller 16 to implement a stop function 21, by shutting off the motor 14 and applying a brake 22. The stop and slowdown points are fixed at a distance from the landing calculated based on maximum car velocity. Maximum car velocity occurs with either a full load down (FLD) or with no load up (NLU).

In the case of full load up (FLU) or no load down (NLD) the car is presumed to be traveling more slowly and the slowdown/stop sequence can be delayed slightly to improve the elevator response time. Delay functions 24 and 26—associated with the slowdown function 19 and stop function 21, respectively—are incorporated in the controller 16 and are triggered in response to the output of a load measuring circuit 28 that is operable to provide signals to the controller indicative of (FLU) and (NLD), as discussed hereinafter.

The load measuring circuit 28 is also operable to provide a signal indicative of (FLD). In response to the (FLU) or (FLD) signals from the load measuring circuit 28, the controller implements a bypass function 29 so that hall calls are not responded to until the car 10 is moving with less than a full load.

Figure 2:
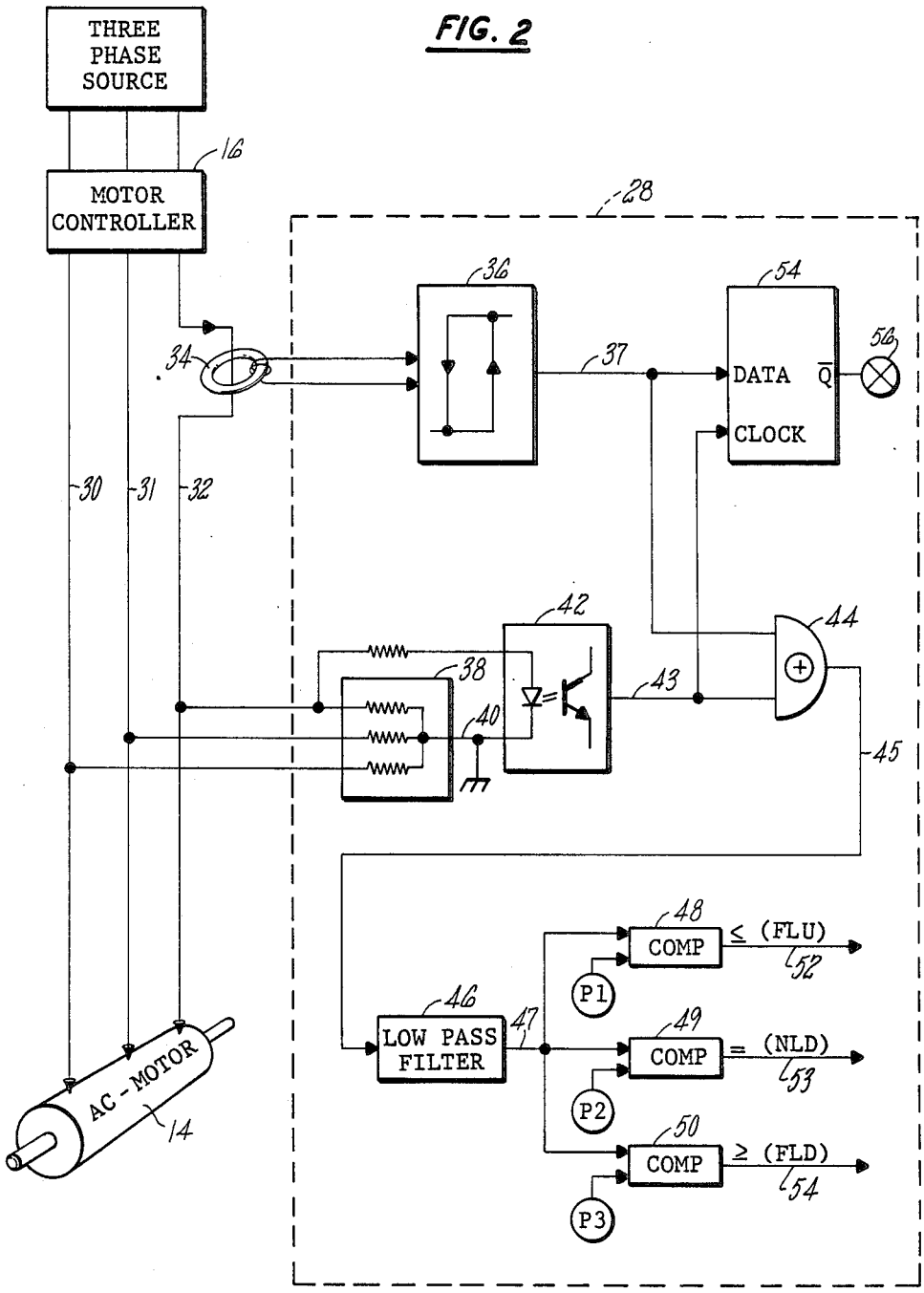
FIG. 2 is a schematic block diagram of the load measuring circuit of this invention.

As shown in FIG. 2, the load measuring circuit 28 is interposed in the AC bus between the controller 16 and the motor 14. The bus has three lines 30–32 and the load measuring circuit 28 measures the phase angle related to one of the lines, such as the line 32.

Figure 3:
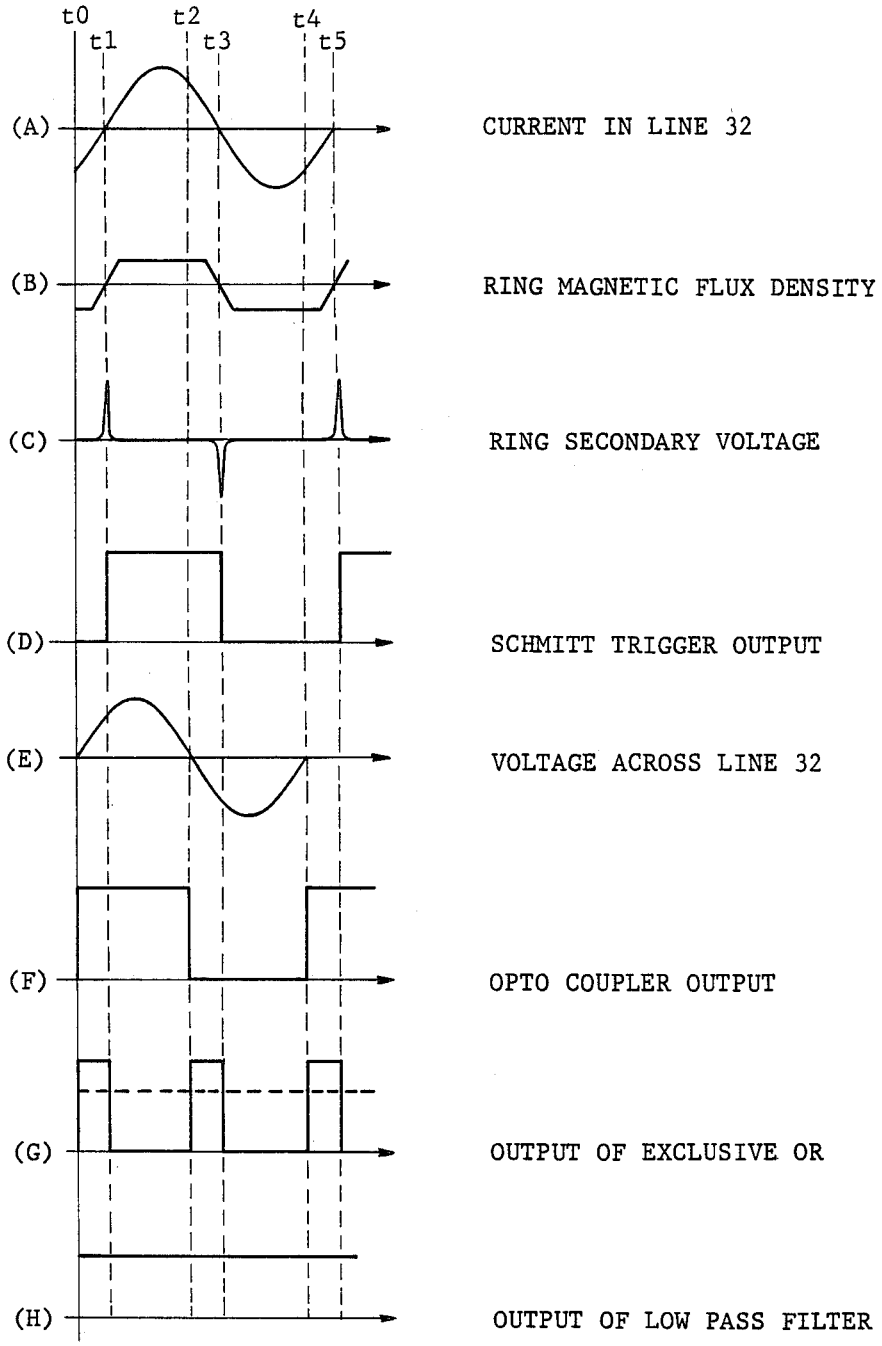
FIG. 3 is a timing diagram of various waveforms throughout the circuit of FIG. 2.

The instantaneous current in the line 32 is sensed by a noncontacting probe 34 and is shown in FIG. 3A. For this example, the current zero crossings occur at times t1, t3, and t5. The probe 34 is a highly permeable ring transducer that is selected to be normally saturated so that its magnetic flux density is linear (nonsaturated) only in the region of the current zero crossings—in other words, at times t1, t3, and t5 as shown in FIG. 3B. Therefore, the transducer secondary voltage is alternating positive and negative pulses in sync with the current zero crossings, as shown in FIG. 3C. A bistable device, such as a Schmitt trigger 36 operated in saturation, is responsive to the secondary pulses and provides a signal on a line 37 that is essentially a square wave, in sync with the current on the line 32, that is positive for positive current excursions and zero for negative current excursions, as shown in FIG. 3D.

A resistor network 38 is connected as shown to the lines 30–32 to provide an artificial ground 40. The voltage with respect to ground for the line 32 is represented in FIG. 3E and has zero crossings at times t0, t2, and t4.

In other words, there is a phase difference (angle) equivalent to (t1–t0) between the current and voltage on the line 32. The phase angle is also equivalent to (t3–t2) or (t5–t4).

An opto coupler 42 is responsive to the instantaneous voltage between the line 32 and ground 40 and is operated in saturation to provide a signal on a line 43 that is essentially a square wave, in sync with the voltage across the line 32, that is positive for positive voltage excursions and zero for negative voltage excursions as shown in FIG. 3F. The opto coupler 42 provides the additional benefit of isolation from the connection to the line 32.

An exclusive OR gate 44 is responsive to the outputs of the Schmitt trigger 36 and the opto coupler 42 and provides an output on a line 45 that is positive for the time during which either output is provided in the absence of the other. In other words, the mark:space ratio on the line 45 is a function of the phase angle.

Figure 4:
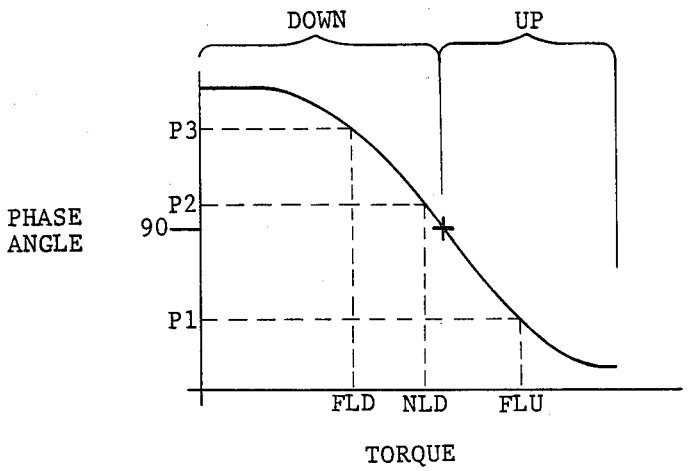
FIG. 4 is a graph of torque versus phase angle showing up and down thresholds indicative of full and empty cars.

Phase (power factor) angle is related to torque or load. For no load, the phase angle is ninety degrees (discounting the counter emf of the motor which remains nearly constant from no load to full load). As shown in FIG. 4, when the elevator is going up, the phase angle decreases with load. When the elevator is going down, the motor acts like a generator and the phase angle increases. A phase angle (P1) corresponds to full load up (FLU), a phase angle (P2) corresponds to no load down, and a phase angle (P3) corresponds to full load down (FLD). the phase angle (P2) is slightly more than ninety degrees due to the weight of the empty car. The gradient of the curve between (FLD) and (FLU) is adequate for reliable sensing.

A low pass filter 46 averages the signal on the line 45 to provide an analog signal on a line 47 as a function of the phase difference. The signal is compared in comparators 48–50 with reference signals indicative of the phase angles (P1) (P2) and (P3) so as to provide an output signal (FLU) on a line 52 when the phase angle is less than or equal to (P1), an output signal (NLD) on a line 53 when the phase angle is substantially equal to (P2), and an output signal (FLD) on a line 54 when the phase angle is at least (P3). These outputs are used in the controller 16 to select the delayed slowdown/stop sequence or bypass hall calls in the manner described hereinbefore with respect to FIG. 1. By changing the values of the comparator references, the system is easily characterized for different elevators.

In order for the load measuring circuit to function, it is important that the transducer 34 and the opto coupler 42 both are reading the same line and that the polarity of the transducer 34 is correct. Out of the six possible ways of clamping the transducer 34 around the three lines 30–32 (i.e., two ways per line), only one is correct for a particular connection of the opto coupler 42. For convenience, a D-type flip-flop 54 is connected as shown to the lines 37 and 43 and will light a lamp 56 via its complimentary output only when the transducer 34 is placed with proper polarity around the line 32. This allows for connection of the load weighing circuit until the proper combination is achieved.

The invention has been described with respect to a particular embodiment thereof. It should be understood that various changes could be made therein and thereto without departing from the spirit and scope of the invention. For instance, the analog functions described herein could readily be implemented by software in a computer-based controller.

What is claimed is:

1. A load measuring circuit (28) for an elevator system having a motor (14) that is energized by a three phase (30–32) AC bus for moving a car (10) up and down in a hoistway (12), characterized by:

current sensing means comprising a ring transducer (34) operated in saturation and driving a Schmitt trigger (36) in saturation for providing a first square wave in sync with the instantaneous current through one of the lines (32) of the AC bus;

a resistor network (38) connected to the three lines (30–32) of the AC bus for providing an artificial ground (40);

voltage sensing means comprising an opto coupler (42) operated in saturation to provide a second square wave in sync with the instantaneous voltage between the one line (32) of the AC bus and the ground (40); and phase angle means comprising an exclusive OR gate (44) connected to the current sensing means and to the voltage sensing means for providing a phase angle signal (45) in proportion to the phase angle between the voltage and the current in the one line (32), wherein the phase angle signal is a series of marks and the mark:space ratio is proportional to the phase angle between the voltage and the current in the one line (32).

2. A load measuring circuit (28) according to claim 1, characterized by:

averaging means (46) responsive to the output of the exclusive OR gate for providing an analog signal (47) as a function of the phase angle.

3. A load measuring circuit (28) according to claim 2, characterized by:

a first comparator (48) for providing a signal (FLU) when the analog signal is less than or equal to a reference that corresponds to a phase angle (P1) indicative of the car (10) moving up the hoistway (12) full; and a second comparator (49) for providing a signal (NLD) when the analog signal is substantially equal to a reference that corresponds to a phase angle (P2) indicative of the car (10) moving down the hoistway (12) empty.

4. A load measuring circuit (28) according to claim 2, characterized by:

a first comparator (48) for providing a signal (FLU) when the analog signal is less than or equal to a reference that corresponds to a phase angle (P1) indicative of the car (10) moving up the hoistway (12) full; and a second comparator (50) for providing a signal (FLD) when the analog signal is at least a reference that corresponds to a phase angle (P3) indicative of the car (10) moving down the hoistway (12) full.

5. Load weighing system according to claim 1, characterized by:

means (54, 56) for providing an output indicative of the current sensing and voltage sensing both being associated with the same line (32) in response to the first and second square waves.

* * * * *